US005452845A

United States Patent [19]

Ritter

[11] Patent Number: 5,452,845

[45] Date of Patent: Sep. 26, 1995

[54] CONTAINER LOCK FLAP CLOSURE ARRANGEMENT

[75] Inventor: Karl M. Ritter, Wheaton, Ill.

[73] Assignee: Jefferson Smurfit Corporation, Clayton, Mo.

[21] Appl. No.: 394,590

[22] Filed: Feb. 27, 1995

[51] Int. Cl.[6] ..... B65D 43/16; B65D 5/66

[52] U.S. Cl. ..... 229/110; 229/149; 229/163; 229/186; 229/906

[58] Field of Search ..... 229/109, 110, 229/149, 150, 163, 186, 902, 906

[56] References Cited

U.S. PATENT DOCUMENTS

| | | | |
|---|---|---|---|
| 1,323,170 | 11/1919 | Dodge | 229/149 |
| 1,574,396 | 2/1926 | Hoy | 229/163 |
| 1,813,298 | 7/1931 | Klin | 229/149 |
| 2,346,206 | 4/1944 | Broderick | 229/163 |
| 4,418,863 | 12/1983 | Kimbrell, Sr. | 229/149 |
| 4,763,832 | 8/1988 | Forbes, Jr. | 229/149 |
| 5,118,032 | 6/1992 | Geho | 229/110 |
| 5,211,329 | 5/1993 | Patton | 229/110 |
| 5,358,173 | 10/1994 | Mertz | 229/149 |
| 5,368,225 | 11/1994 | Ritter | 229/110 |
| 5,402,929 | 4/1995 | Ritter et al. | 229/110 |

*Primary Examiner*—Gary E. Elkins
*Attorney, Agent, or Firm*—Richard W. Carpenter

[57] ABSTRACT

A lock flap closure arrangement for one-piece, collapsible, tray-type, paperboard container which container includes a tray and a cover hinged to the tray. The closure arrangement includes a tray cover with at least one lock flap having a T-shaped lock tab hinged thereto with a major port ion adapted to be inserted into a complementary receiving opening in an adjacent area of the tray.

20 Claims, 2 Drawing Sheets

CI
152
161
163
160
162
166
164
112
141b
147
149
145
TI 8
140
141a
132

10

12

14

15

CONTAINER LOCK FLAP CLOSURE ARRANGEMENT

BACKGROUND OF THE INVENTION

1. Field of the Invention

This invention relates to tray type, paperboard containers with hinged covers, and, more particularly, to an improved lock flap arrangement for a container tray-cover closure.

2. Description of the Background Art

A background art search directed to the subject matter of this invention conducted in the U.S. Patent and Trademark Office disclosed the following U.S. and foreign Pat. Nos:

| | | | |
|---|---|---|---|
| 2,060,159 | 2,102,497 | 2,157,062 | 2,344,008 |
| 2,400,443 | 2,473,492 | 2,572,159 | 2,789,750 |
| 3,261,537 | 3,580,482 | 3,767,105 | 5,358,173 |
| 5,368,225 | DT4,035,372 | IT685,654 | FR1,355,681 |

None of the patents uncovered in the search discloses a one-piece, collapsible, tray-type, paperboard container that includes a tray and hinged cover that has, depending therefrom, at least one lock flap with a T-shaped lock tab hinged thereto which has a major portion adapted to be inserted into complementary receiving opening in an adjacent portion of the tray.

SUMMARY OF THE INVENTION

It is a primary object of the invention to provide an improved corner closure arrangement for a collapsible, one-piece, tray type, paperboard container with hinged cover.

Another object of the invention is the provision, for a container of the type described, of an improved automatic lock flap arrangement between the tray and cover.

A more specific object of the invention is to provide a lock flap closure wherein a lock flap hinged to a tray cover has hinged thereto a generally T-shaped lock tab adapted to be received within a complementary opening in the tray.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

The present invention represents an improvement over the tray and cover closure flap arrangements disclosed in U.S. Pat. Nos. 5,358,173; 5,368,225, and co-pending application of the Applicant, Karl M. Ritter and Noel J. Mertz, Ser. No. 08/293,149, filed Aug. 19, 1994.

Although the lock flap closure of the present invention is shown as applied to a particular type of container that is illustrated in FIGS. 1–5, it should be understood that the invention can be used in many different types of tray-cover closure arrangements, the basic concept being illustrated in FIGS. 6–15.

Figure 1:
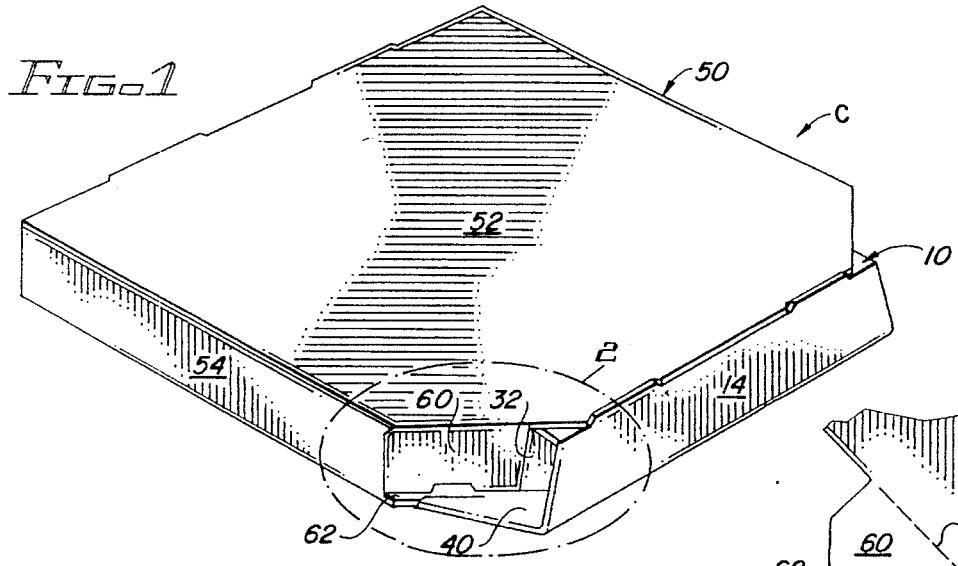
FIG. 1 is an isometric view of a container with a tray-cover lock flap closure arrangement embodying features of the invention.
Figure 2:
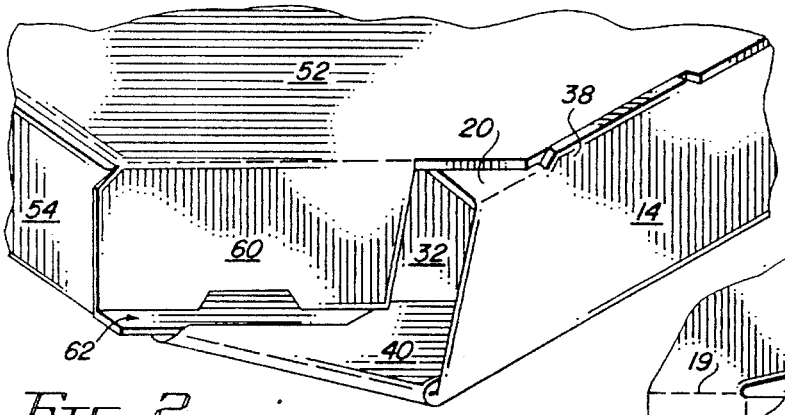
FIG. 2 is an enlarged view of a portion of the structure shown in FIG. 1.
Figure 3:
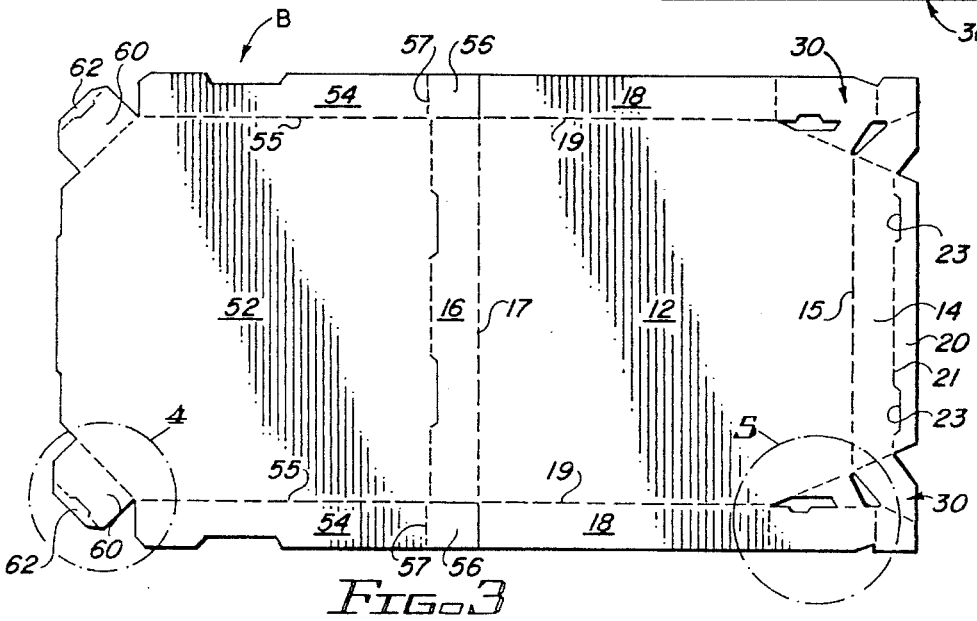
FIG. 3 is a plan view of the blank of sheet material used to form the container illustrated in the other views.

Referring now to the drawings for a better understanding of the invention, and particularly to FIGS. 1–5, it will be seen that the tray type container, embodying features of the invention and indicated generally at C in FIG. 1, may be formed from the unitary blank of foldable paperboard indicated generally at B in FIG. 3.

As best seen in FIG. 3, the tray, indicated generally at 10 includes a hexagonal bottom wall panel 12 with a front wall panel 14 and a rear end wall panel 16 foldably joined to front and rear edges thereof along fold lines 15 and 17, respectively; and a pair of side wall panels 18, foldably joined to opposed side edges thereof along fold lines 19. Bottom wall panel 12 has a pair of truncated front corners defined by corner diagonal edges.

A retaining flap 20 is foldably joined to the upper edge of front end wall panel 14, along fold line 21, to form, with panel 14, an L-shaped front wall 22. As best seen in FIGS. 2 and 3, portions of retaining flap 20 are cut to provide a pair of lock tab receiving openings 23, located adjacent fold line 21.

Figure 5:
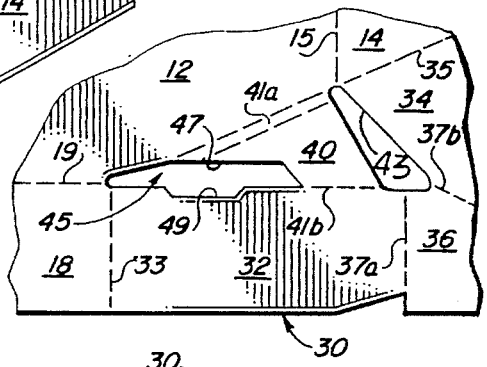

As best seen in FIGS. 2 and 5, the front end edges of tray side wall panels 18 are spaced from the adjacent side edges of front wall end panel 14, but are connected thereto at the front corners of the tray by a pair of four-section corner gussets, indicated generally at 30.

Each gusset 30 includes a first or side section 32, foldably joined along a fold line 33 to a front edge of a related tray side wall panel 18; a second or front section 34, foldably joined along a fold line 35, to an adjacent side edge of tray front end panel 14; a third or corner section 36, foldably joined along a fold line 37*a* to first section 32, and foldably joined along a fold line 37*b* to second section 34; and a fourth or reinforcing section 40, foldably joined along a fold line 41*a* to a related bottom wall panel diagonal front corner edge, and foldably joined along a fold line 41*b* to a lower edge of gusset first section 32.

Each gusset third section may be provided, at its upper edge, with a projection 38 that serves as a lock tab, receivable within opening 23 in the tray front wall retaining flap 20, to provide an interlocking connection, through the gusset 30, between the tray side wall panel 18 and front end wall 14, as hereinafter described.

As best seen in FIG. 5, gusset fourth section is separated from gusset second section 34 by an opening 43 that provides relief and facilitates the folding operation that is required to erect the container tray.

Still referring to FIG. 5, it will be seen that gusset fourth section 40 defines, with gusset first section 32 and tray bottom wall panel 12, an opening 45 that is generally T-shaped or arrow-head shaped and includes a trapezoidal major portion 47 and a smaller generally rectangular minor portion 49.

In the present invention, tray 10 is provided with a hinged cover, indicated generally at 50, which includes a pair of lock flaps 60 adapted to cooperate and interlock with the related portions of the tray in a manner hereinafter described.

As seen in FIGS. 1 and 3, cover 50 includes a hexagonal top wall panel 52, foldably joined, at its rear edge along fold line 53, to the upper edge of tray rear end wall panel 16, and a pair of depending side wall panels 54, foldably joined along fold lines 55 to opposed side edges of top wall panel 52.

Cover 50 also includes a pair of lock flaps 60, foldably joined on fold lines 61 to diagonally extending front corner edges of cover top wall panel 52, and each having a lock tab 62 foldably joined to its free lower edge along axially spaced fold lines 63.

Figure 4:
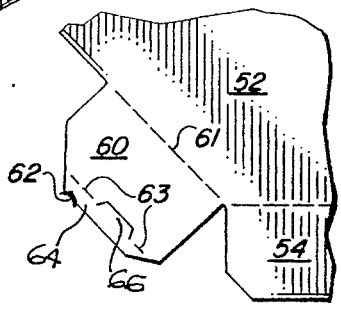
FIGS. 4 and 5 are enlarged views of portions of the structure illustrated in FIG. 3.

As best seen in FIGS. 4 and 5, each lock tab 62 is congruent to its related tray opening 45 and includes a trapezoidal major portion 64, that extends outwardly from a lower free edge of the lock flap to which it is hinged, and a rectangular minor portion 66, that is cut from material of the related lock flap and defined by a cut line 67.

Although the tray side wall panels may be connected to the tray rear end wall panel in different ways, in the invention of the present application the cover side wall panels 54 are shown as having rear corner flaps 56 foldably joined to their rear edges along fold lines 57. The rear corner flaps 56 may be folded inwardly against the inner surface of the tray rear end wall panel 16 when the container tray is erected as hereinafter described.

In order to erect the tray, the front end wall panel 14 and the side wall panels 18 are folded upwardly from the bottom wall panel 12. At the same time gusset second and third sections 34 and 36 are folded inwardly until second section 34 lies against the inner or rear surface of front end wall panel 14, and third section 36 lies against portions of the inner or rear surfaces of both second section 34 and front wall panel 14.

At the same time gusset first and fourth sections 32 and 40, respectively, are folded inwardly, with the fourth sections overlying the upper surface of bottom wall panel 12, to position gusset first sections 32 inboardly of the tray bottom wall panel corner edges 14, and normal to the plane of the bottom wall panel.

Then the tray front end wall retaining flap 20 is folded inwardly 90 degrees with the gusset third section lock tabs 38 engaged in the respective front end wall recesses 23. This provides a relatively rigid container corner construction that can be easily and quickly erected.

In order to close the container cover, after the tray has been filled, the tray rear wall end panel 16 is folded to the vertical position, with the cover rear corner flaps 56 being folded inwardly to lie against the inner surface of tray rear end wall panel 16.

The cover can then be folded downwardly and locked to the tray by the unique lock flaps 60 and lock tabs 62 which are the essential feature of the present invention.

As each lock flap 60 is folded downwardly to a vertical position, its related lock tab 62 is rotated 90 degrees about spaced hinge lines 63 until it is in a horizontal position.

At this time the lock tab 62 of each lock flap 60 is inserted into the related opening 45, until it is positioned in full face engagement with the upper surface of the tray bottom wall panel, with the major portion 64 of the lock tab snugly received within the major portion 47, and with the minor portion 66 of the lock tab extending through the minor portion 49 of the opening 45 to lock the cover securely in place over the tray.

Turning now to FIGS. 6–15 of the drawings, it will be seen that a slightly modified form of the invention is illustrated. Elements corresponding to elements of the previously described embodiment have been identified by related numerals.

The only difference between the structure illustrated in FIGS. 6–15 and that illustrated in FIGS. 1–5 is that the latter structure is generic to any type of container that has a tray T1 and an interlocking cover C1.

Figures 6, 7, 8, 9, 10, 11, 12, 13, 14, 15:
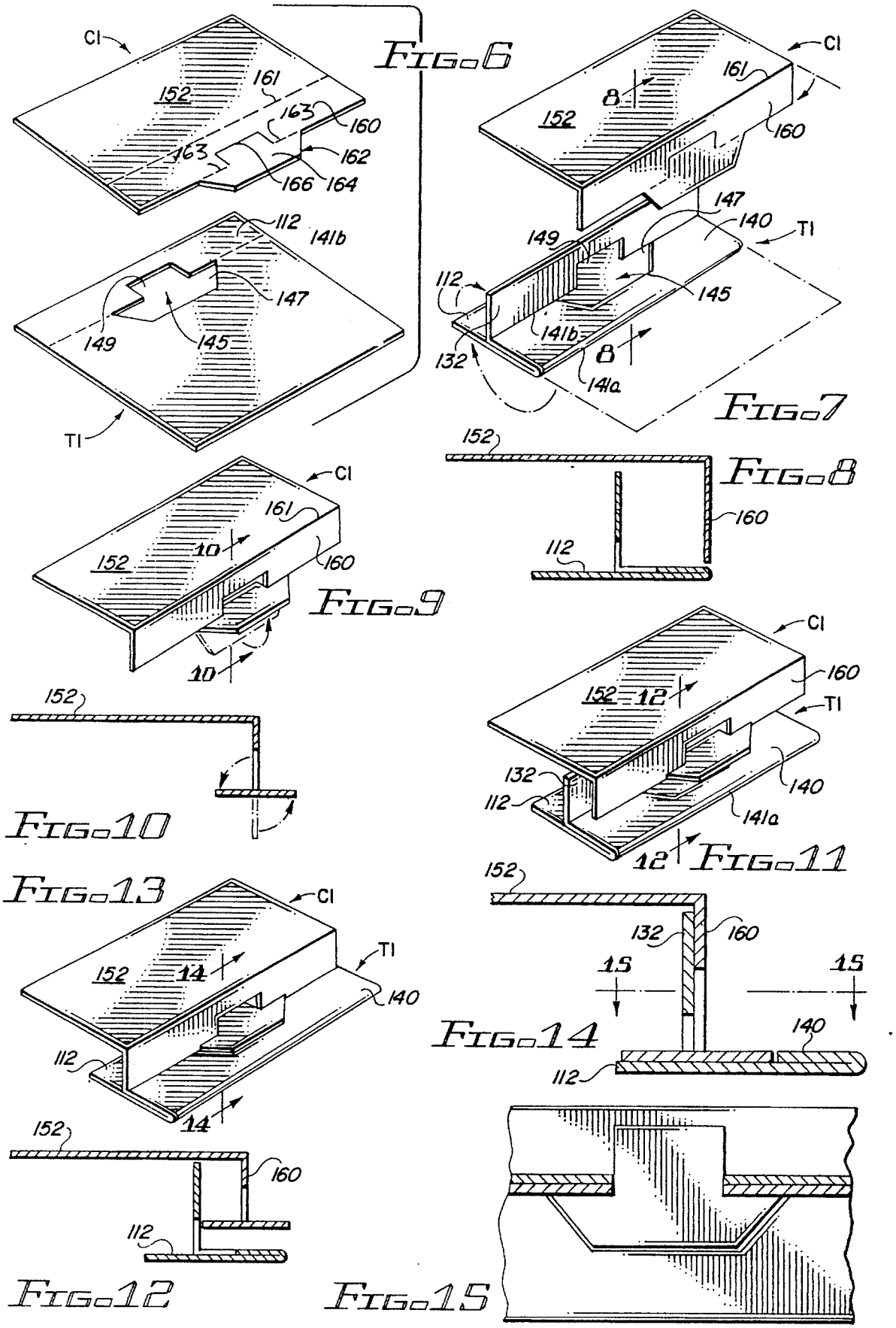
FIG. 6 is a partial isometric view of a slightly modified form of the invention that shows portions of a container cover and tray before being folded and attached to each other.
FIG. 7 is a view similar to that of FIG. 6, but showing the cover and tray portions after certain folding operations have taken place.
FIG. 8 is a vertical sectional view taken on line 8—8 of FIG. 7.
FIG. 9 is an isometric view similar to that of FIG. 7, but showing the cover portion after the lock tab has been folded 90 degrees with respect to the related lock flap.
FIG. 10 is a vertical sectional view taken on line 10—10 of FIG. 9.
FIG. 11 is an isometric view similar to that of FIG. 7, but showing the tray and cover portions completely folded and ready to be moved into engagement with each other.
FIG. 12 is a vertical sectional view taken on line 12—12 of FIG. 11.
FIG. 13 is an isometric view similar to that of FIG. 7, but showing the container tray and cover portions after they have been moved into interlocking engagement with each other.
FIG. 14 is an enlarged, vertical, sectional view taken on line 14—14 of FIG. 13.
FIG. 15 is a horizontal sectional view taken on line 15—15 of FIG. 14.

As best seen in FIG. 7, Cover C1 top wall 152 has a lock flap 160 foldably joined to an edge thereof, along a fold line 161. Lock flap 160, which is folded downwardly into a vertical position, has foldably joined to a free lower edge thereof, along a pair of axially aligned fold lines 163, a generally T-shaped lock tab 162.

Tray T1 has a bottom wall panel 112, an overlying flange 140, corresponding to gusset fourth section 40 of FIG. 2, a vertical wall panel 132, corresponding to gusset first section 32, and an opening 145, with major and minor portions 147 and 149, that correspond to portions 47 and 49 of the opening 45 in FIG. 5.

The operation of the lock flap closure arrangement of the embodiment illustrated in FIGS. 6–15 is the same as that of the embodiment illustrated in FIGS. 1–5.

In each case there is provided a sure and snug interlocking connection between a tray and cover that can be easily and quickly attached and/or detached.

What is claimed is:

1. An improved lock flap closure arrangement for a tray type container with hinged cover, said container being formed from a unitary blank of foldable paperboard, and comprising:

(a) a tray including:

(i) a horizontal bottom wall panel;

(ii) a horizontal second panel overlying at least a portion of said bottom wall panel in face-to-face engagement therewith;

(iii) a vertical panel foldably joined to an edge of said second panel and upstanding therefrom;

(iv) a lock tab receiving opening having a major portion in said second panel and a minor portion in said vertical panel;

(b) an integral hinged cover, including:

(i) a top wall panel;

(ii) a lock flap foldably joined to an edge of said top wall panel and depending therefrom;

(iii) a generally T-shaped lock tab foldably joined, intermediate its front and rear edges, to a lower edge of said lock flap along a pair of axially spaced fold lines;

(c) said lock tab including a generally trapezoidal major portion, extending from said lock flap lower edge, and a generally rectangular minor portion cut from said lock flap;

(d) said lock tab major and minor portions being generally congruent to said tray lock tab receiving opening major and minor portions and being arranged and disposed to be received therein when said lock tab is rotated 90 degrees relative to the lock flap.

2. An arrangement according to claim 1, wherein said lock tab major portion is tapered with forwardly converging side edges.

3. An arrangement according to claim 1, wherein said tray vertical panel is part of a gusset that connects a tray side wall panel to a tray front wall panel.

4. An arrangement according to claim 1, wherein said tray horizontal second panel is part of a gusset that connects a tray side wall panel to a tray front wall panel.

5. An arrangement according to claim 1, wherein said tray vertical panel and said tray horizontal second panel are part of a gusset that connects a tray side wall panel to a tray front wall panel.

6. An arrangement according to claim 1, wherein a side portion of said lock tab extends outboardly a slight distance beyond said tray horizontal second panel.

7. An improved lock flap closure arrangement for a tray type container with hinged cover, said container being formed from a unitary blank of foldable paperboard, and comprising:

(a) a tray including:

(i) a horizontal bottom wall panel;

(ii) a horizontal second panel overlying at least a portion of said bottom wall panel in face-to-face engagement therewith;

(iii) a vertical panel foldably joined to an edge of said second panel and upstanding therefrom;

(iv) a lock tab receiving opening having a major portion in said second panel and a minor portion in said vertical panel;

(b) an integral hinged cover, including:

(i) a top wall panel;

(ii) a lock flap foldably joined to an edge of said top wall panel and depending therefrom;

(iii) a generally T-shaped lock tab foldably joined, intermediate its front and rear edges, to a lower edge of said lock flap along a pair of axially spaced fold lines;

(c) said lock tab including a major portion, extending from said lock flap lower edge, and a minor portion cut from said lock flap;

(d) said lock tab major portion being generally congruent to said tray lock tab receiving opening major portion and being arranged and disposed to be received therein when said lock tab is rotated 90 degrees relative to the lock flap.

8. An arrangement according to claim 7, wherein said lock tab major portion is tapered with forwardly converging side edges.

9. An arrangement according to claim 7, wherein said tray vertical panel is part of a gusset that connects a tray side wall panel to a tray front wall panel.

10. An arrangement according to claim 2, wherein said tray horizontal second panel is part of a gusset that connects a tray side wall panel to a tray front wall panel.

11. An arrangement according to claim 7, wherein said tray vertical panel and said tray horizontal second panel are part of a gusset that connects a tray side wall panel to a tray front wall panel.

12. An arrangement according to claim 7, wherein a side portion of said lock tab extends outboardly a slight distance beyond said tray horizontal second panel.

13. An arrangement according to claim 7, wherein said lock tab major portion is arranged and disposed to lie in face-to-face engagement with said tray bottom wall panel when said cover is in a closed and locked position.

14. An improved lock flap closure arrangement for a tray type container with cover, said container being formed from a unitary blank of foldable paperboard, and comprising:

(a) a tray including:

(i) a horizontal bottom wall panel;

(ii) a horizontal second panel overlying at least a portion of said bottom wall panel in face-to-face engagement therewith;

(iii) a vertical panel foldably joined to an edge of said second panel and upstanding therefrom;

(iv) a lock tab receiving opening in said second panel;

(b) a cover, including:

(i) a top wall panel;

(ii) a lock flap foldably joined to an edge of said top wall panel and depending therefrom;

(iii) a lock tab foldably joined, intermediate its front and rear edges, to a lower edge of said lock flap along a pair of axially spaced fold lines;

(c) said lock tab including a first portion, extending from said lock flap lower edge, and a second portion cut from said lock flap;

(d) said lock tab first portion being arranged and disposed to be snugly received within said tray lock tab receiving opening when said lock tab is rotated 90 degrees relative to the lock flap.

15. An arrangement according to claim 14, wherein said lock tab first portion is tapered with forwardly converging side edges.

16. An arrangement according to claim 14, wherein said tray vertical panel is part of a gusset that connects a tray side wall panel to a tray front wall panel.

17. An arrangement according to claim 14, wherein said tray horizontal second panel is part of a gusset that connects a tray side wall panel to a tray front wall panel.

18. An arrangement according to claim 14, wherein said tray vertical panel and said tray horizontal second panel are part of a gusset that connects a tray side wall panel to a tray front wall panel.

19. An arrangement according to claim 14, wherein a side portion of said lock tab extends outboardly a slight distance beyond said tray horizontal second panel.

20. An arrangement according to claim 14, wherein said lock tab major portion is arranged and disposed to lie in face-to-face engagement with said tray bottom wall panel when said cover is in a closed and locked position.

* * * * *